United States Patent [19]

Tanaka

[11] Patent Number: 4,958,778

[45] Date of Patent: Sep. 25, 1990

[54] DEVICE FOR CONTINUOUSLY WINDING A WIRE-LIKE ELEMENT

[75] Inventor: Satoshi Tanaka, Kanagawa, Japan

[73] Assignee: Sumitomo Electric Industries, Ltd., Osaka, Japan

[21] Appl. No.: 378,974

[22] Filed: Jul. 11, 1989

[30] Foreign Application Priority Data

Jul. 12, 1988 [JP] Japan ..... 63-171925

[51] Int. Cl.[5] ..... B65H 67/052

[52] U.S. Cl. ..... 242/25 A

[58] Field of Search ..... 242/25 A, 25 R, 18 A, 242/18 PW, 18 R, 18 G

[56] References Cited

U.S. PATENT DOCUMENTS

| | | | |
|---|---|---|---|
| 3,695,528 | 10/1972 | Taki et al. | 242/25 A |
| 3,831,871 | 8/1974 | Ikegami et al. | 242/25 A X |
| 4,044,960 | 8/1977 | Lemaire | 242/25 A |
| 4,557,423 | 12/1985 | Zingler | 242/25 A X |

FOREIGN PATENT DOCUMENTS

| | | |
|---|---|---|
| 948298 | 1/1964 | United Kingdom . |
| 958612 | 5/1964 | United Kingdom . |
| 960629 | 6/1964 | United Kingdom . |
| 1152698 | 5/1969 | United Kingdom . |
| 1367513 | 9/1974 | United Kingdom . |
| 1506192 | 4/1978 | United Kingdom . |
| 1534951 | 12/1978 | United Kingdom . |
| 1546182 | 5/1979 | United Kingdom . |

*Primary Examiner*—Stanley N. Gilreath

*Attorney, Agent, or Firm*—Cushman, Darby & Cushman

[57] ABSTRACT

An arrangement for continuously winding a wire-like element on at least two bobbins. Winding is switched from bobbin to bobbin in an efficient and stable manner. Even when the bobbins rotate at high-speed, it is possible to achieve a clean switch. A mechanically-limiting device allows a member for operating a catch device to operate only at a predetermined angular position of a bobbin.

5 Claims, 4 Drawing Sheets

DEVICE FOR CONTINUOUSLY WINDING A WIRE-LIKE ELEMENT

BACKGROUND OF THE INVENTION

1. Field of the Invention

This invention relates to a device for continuously winding a wire-like element. The invention is particularly well suited for use with an optical fiber.

2. Description of the Prior Art

Devices are known in the art which wind a wire-like element such as an optical fiber. Such devices generally include two bobbins which are wound alternately so as to effect a continuous winding of the wire-like element. FIG. 3 is a schematic view of such a device and FIGS. 4(*a*)–(*i*) show the operation of the device of FIG. 3.

Referring to FIG. 3, first and second bobbins 13 and 14 are driven by motors 11 and 12 respectively. The wire-like element 15 is guided by guide roller 16 so that element 15 can be switched between bobbins 13 and 14 on which it is being wound. Each of bobbins 13 and 14 has a catch, device 17 depicted only on bobbin 13 in FIGS. 4(*a*)–(*i*) Such a catch device is described in Japanese Patent Publication No. 11825/82.

Referring to FIGS. 4(*a*)–4(*i*) device 17 is made of a guide disc 18 arranged coaxially with bobbins 13 and 14 and rotatable therewith, a catch arm 20 angularly movably supported on the peripheral portion of guide disc 18 and having a catch rubber 19 with a V-shaped groove, a spring 21 urging catch arm 20 to be inwardly retracted, and a cam 22 angularly movably supported on guide disk 18 and engaged with catch arm 20. The catch device is operated at a predetermined timing by cam plate 23 mounted exterior to and adjacent to guide disc 18.

The switching between bobbins 13 and 14 of the above-described device is described below. When the wire-like element is being wound on bobbin 14, guide roller 16 is disposed between bobbins 13 and 14 as is shown in FIGS. 4(*a*), 4(*d*) and 4(*g*)so as to guide the winding toward bobbin 14. The cam plate 23 is disengaged from cam 22 so that catch arm 20 is disposed in its inwardly-retracted position.

When bobbin 14 has been filled, guide roller 16 moves in the direction of bobbin 13, as shown in FIGS. 4(*b*), 4(*e*) and 4(*h*) so as to bring wire-like element 15 into contact with the body of bobbin 13. The cam plate 23 is operated so as to urge cam 22 causing catch arm 20 to project inside of bobbin 13 against the bias of spring 21. During the rotation of the catch arm 20, catch rubber 19 catches the wire-like element 15 in its V-shaped groove and cuts it.

Then, as shown in FIGS. 4(*c*), 4(*f*) and 4(*i*) cam plate 23 is released to retract catch arm 20, thus completing the switching of the wire-like element 15 to bobbin 13. When it is desireable to switch in the reverse order, that is from bobbin 13 to 14, the catch device 17 on bobbin 14 (not shown) is responsible for carrying out the switching operation.

The cam plate 23 of the device described above is driven by a solenoid through a link 25 as shown in FIG. 5. The timing of the movement of cam plate 23 is detected through the bobbin shaft. The solenoid 24 is operated in response to a signal from a sequencer of a controller.

Cam plate 23 must be operated when catch device 17 is located at a success zone shown in FIG. 6. If cam plate 23 is operated when catch device 17 is located in a failure zone immediately before a catch point P where catch device 17 can catch wire-like element 15, catch arm 20 is projected in an incomplete condition. When this occurs, the V-shaped groove of a catch rubber 19 does not catch element 15, therefore resulting in a failure to switch the winding. A timing pulse is therefore generated when the bobbin shaft is at a predetermined angular position, and this timing pulse operates the solenoid 24 at a predetermined time.

Even when a timing pulse is generated at a predetermined time, variations arise in a scan time of a sequencer and thus the operation of solenoid 24. The timing of the operation of the cam plate 23 is subject to a variation time interval of length $T_o$.

If the time during which catch device 17 is disposed in the success zone extending over an angle of Y° is called $S_o$, it can be found that:

$S_o$ =(time per revolution of bobbin) = x When the bobbin rotates at a low rate of speed, the cam plate 23 can be successfully operated during the interval $S_o$ regardless of the interval $T_o$ since $S_o$ is sufficiently long compared to time $T_o$ as shown in FIG. 7. However, when the bobbin rotates at a high rate of speed, time $S_o$ becomes smaller as depicted in FIG. 8. When $S_o$ is sufficiently short compared to $T_o$, proper operation of catch device 17 becomes difficult. Due to both electrical and mechanical factors, a variation time $T_o$ is inherent in this system as are the problems at high bobbin rotation speeds.

SUMMARY OF THE INVENTION

The present invention addresses the problems of the prior art discussed above. An object of the present invention is to provide apparatus which enables bobbins to be switched in a stable and reliable manner. The present invention has successfully eliminated variation in the timing of the operation of the catch device.

The present invention includes a catch device for successfully catching the wire-like element when switching bobbins. A mechanically-limiting device which allows a member for operating the catch device to work only at a predetermined angular position of the bobbin is provided in the present invention. Variation of operating time due to electrical factors can be eliminated. Continuous winding is possible since it is not necessary to stop or decelerate the wire-like element when effecting the bobbin switching.

Other objects, features, and characteristics of the present invention, as well as the methods of operation and functions of the related elements of the structure will become apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The advantages of the present invention may be better understood and appreciated by studying the detailed description of the preferred exemplary embodiment in conjunction with the drawings in which.

DETAILED DESCRIPTION OF THE PRESENTLY PREFERRED EXEMPLARY EMBODIMENT

Figure 1A:
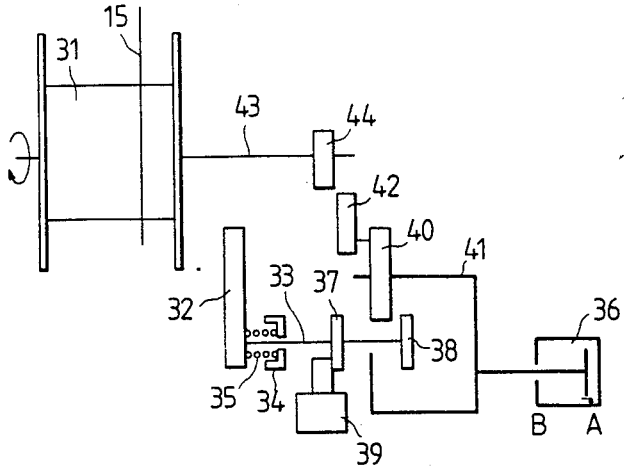
FIGS. 1(*a*)–1(*c*) are schematic views of one preferred embodiment of the present invention.
Figure 1B:
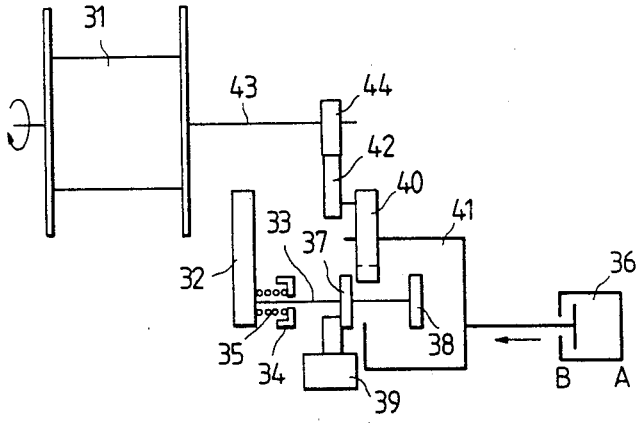
Figure 1C:
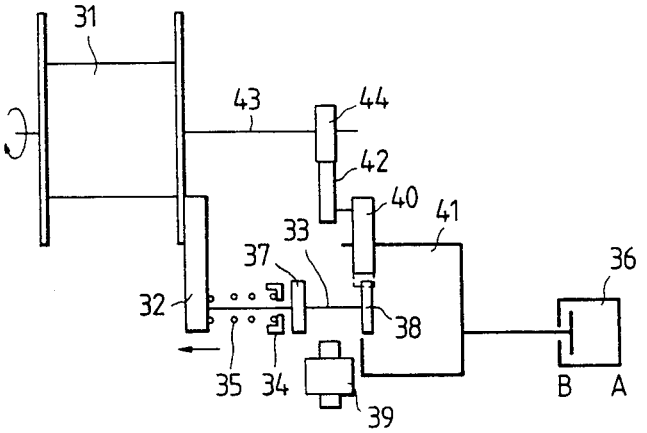

Referring to FIGS. 1(*a*)–1(*c*), a wire-like element 15 is wound on a bobbin 31. A cam plate 32 is designed to operate a catch device (not shown) mounted on bobbin 31. The catch device operates by urging cam plate 32 towards bobbin 31 at a specified time so that it is possible to switch the winding from one bobbin to another. Cam plate 32 is fixedly attached to a front end of movable shaft 33 supported as to be movable toward and away from the catch device of bobbin 31. The movable shaft 33 is urged toward the catch device by an urging device comprising a compression coil spring 35 interposed between a spring retainer 34 and cam plate 32. Due to this urging force, cam plate 32 operates the catch device. A returning device made of an air cylinder 36 is connected to shaft 33. After a switch between bobbins, shaft 33 is returned to its original position by the air cylinder 36 against the bias of the compression coil spring 35.

First and second collars 37 and 38 are also mounted on moveable shaft 33 and are engageable with a first and second trigger, respectively. The first trigger comprises a solenoid 39 electrically driven by a controller. Solenoid 39, which is in an ON state when shaft 33 is returned by air cylinder 36 against the bias of the compression coil spring 35, is engaged with first collar 37 so as to limit the movement of shaft 33. When solenoid 39 is in an OFF state, the engagement between solenoid 39 and first collar 37 is released.

The second trigger, a mechanically-limiting device, comprises a swinging plate 40 supported on a movable frame 41 connected to cylinder 36. Plate 40 swings between the ON and OFF state. When swinging plate 40 is in the ON state, it is engaged with second collar 38 so as to limit the movement of shaft 33, and in the OFF state, swinging plate 40 allows collar 38 to move. Cam follower 42 is fixedly mounted on plate 40. A timing detection cam 44 that drives cam follower 42 is mounted on a bobbin shaft 43 of bobbin 31. Similar to the operation of cylinder 36, cam follower 42 is engaged and disengaged from cam 44. When these two members are engaged, the rotation of cam 44, caused by the rotation of bobbin shaft 43, causes plate 40 to swing through cam follower 42. Plate 40 is in the OFF state only when bobbin 31 is at a predetermined angular position for the purpose of switching bobbins.

When element 15 is being wound on bobbin 31, the piston of cylinder 36 is disposed at a position A, as shown in FIG. 1(*a*), and cam plate 32 is disengaged from bobbin 31. First collar 37 on shaft 33 is held in place by solenoid 39. Cam follower 42 is disengaged from timing detection cam 44.

Figure 2:
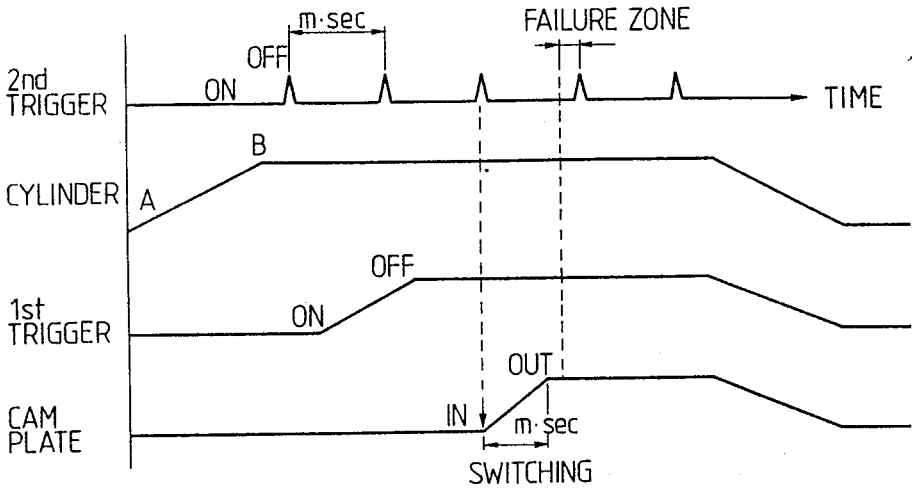
FIG. 2 is a diagrammatic illustration showing the timing, of the operation of the apparatus of FIGS. 1(*a*)–1(*c*)
Figure 3:
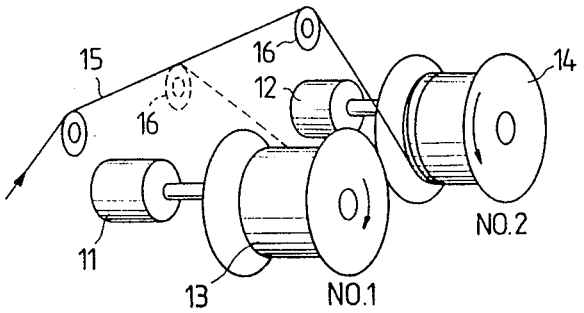
FIG. 3 (PRIOR ART)
FIG. 3 shows a schematic of a prior art invention.
Figures 4A, 4B, 4C, 4D, 4E, 4F, 4G, 4H, 4I:
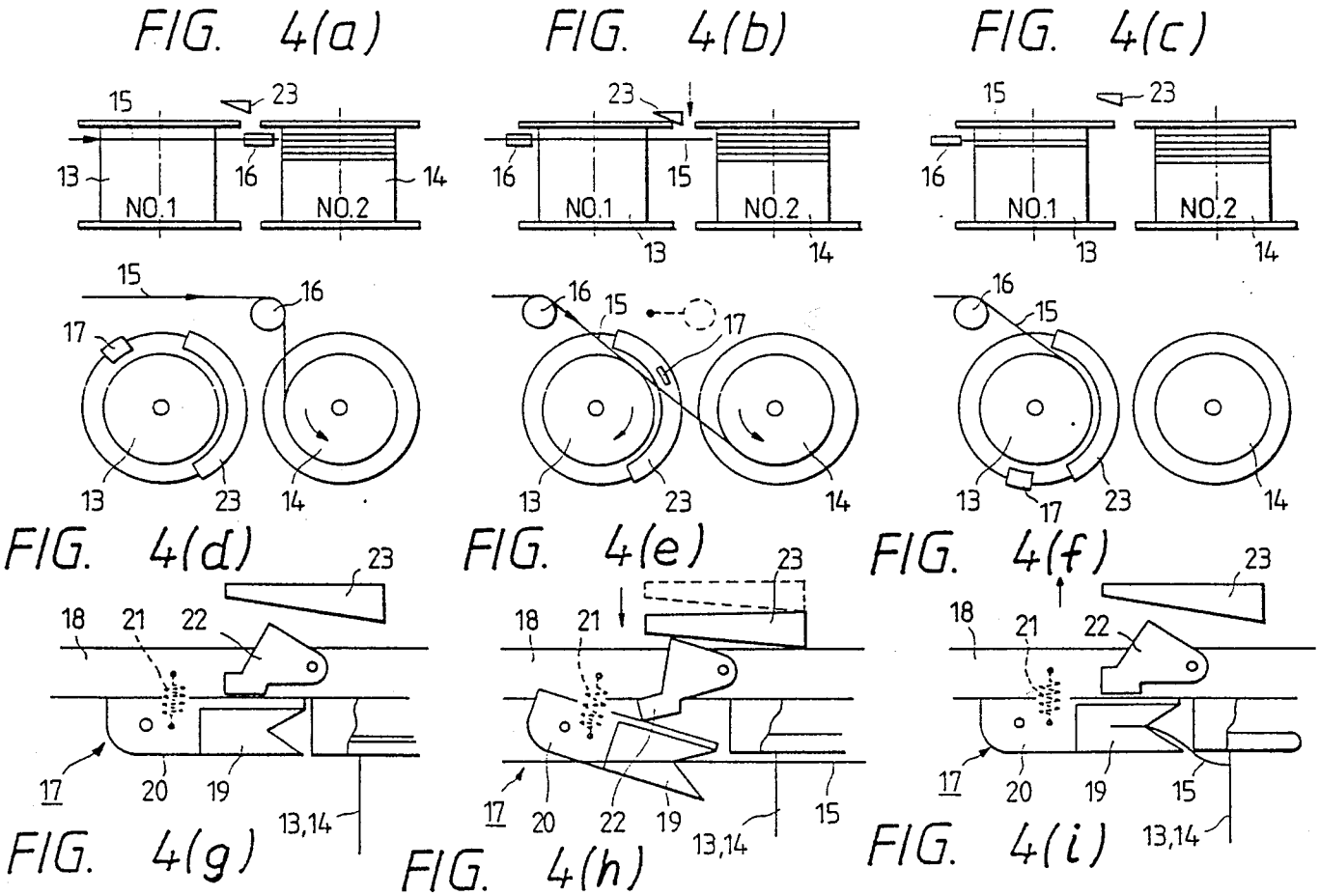
FIGS. 4(*a*)–4(*i*) show schematic views of the prior art of FIG. 3.
Figure 5:
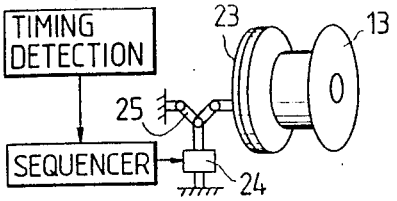
FIG. 5 (PRIOR ART)
FIG. 5 is another schematic view of prior art apparatus.
Figure 6:
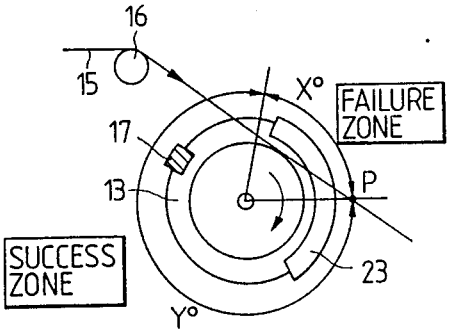
FIG. 6 is a schematic view of the timing of the operation of a catch device.
Figure 7:
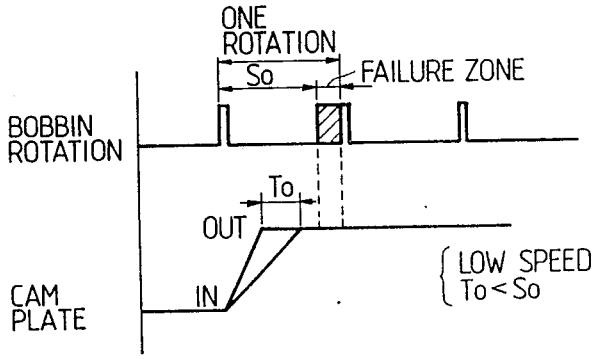
FIG. 7 (PRIOR ART)
FIGS. 7 and 8 are diagrammatic illustrations showing the timing of low- and high-speed operation of the prior art.
Figure 8:
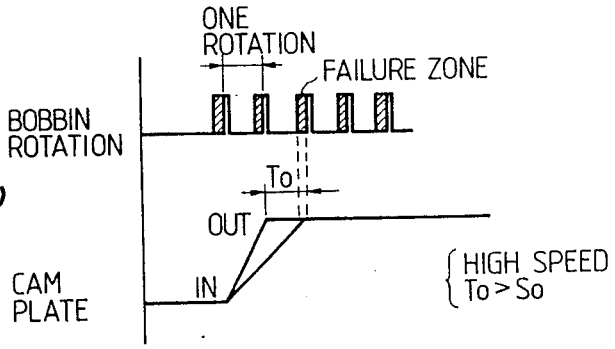
FIG. 8 (PRIOR ART)

As the apparatus approaches the time when it is desired to switch between bobbins, cylinder 36 moves to position B as shown in FIG. 1(*b*), and the cam follower 42 is brought into contact with timing detection cam 44. As a result, plate 40 is repeatedly swung between the ON and OFF states in accordance with the rotation of bobbin 31 as is shown by the timing diagram of the second trigger in FIG. 2. Because the solenoid 39 serving as the first trigger is in the ON state, shaft 33 is kept retained, therefore restraining cam plate 32.

The next step to achieve successful switching is for the solenoid 39 to move to the OFF state, as shown in FIG. 1(*c*). Even when solenoid 39 is moved to the OFF state, cam plate 32 does not operate immediately. When plate 40 is opened (OFF state), the restriction of movement of shaft 33 is taken away enabling cam plate 32 to operate. When both the first and second triggers are OFF, cam plate 32 is pushed by compression coil spring 35 so as to engage bobbin 31. The variation due to electrical factors does not effect this apparatus, as the timing of the second trigger operation is achieved through the mechanical connection to the bobbin shaft 43. Cam plate 32 can therefore be operated at a definite time to effect switching. The time between the start and end of the cam plate 32 is determined by the spring constant of compression coil spring 35. When bobbin 31 rotates at a high speed, a spring 35 with a larger spring constant is used to achieve switching.

After the bobbin has been switched, piston 36 is returned to position A so that the movable shaft can be returned and restrained by solenoid 39. The cam follower is also disengaged from the timing detection cam 44.

While the invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims.

What is claimed is:

1. A device for continuously winding a wire-like element comprising:

first and second bobbins on which the wire-like element is wound;

first and second cam plates movable towards the first and second bobbins respectively, at respective specified times for switching winding between bobbins;

first and second movable shafts supporting the first and second cam plates respectively;

means for urging each of the first and second shafts toward their respective bobbins so as to move the respective cam plates into contact with their respective bobbins so as to switch winding from one bobbin to the other; and first and second trigger mechanisms associated with each movable shaft for limiting the movement of the shaft.

2. A device according to claim 1, wherein said first trigger mechanism includes:

a first collar mounted on said movable shaft; and a solenoid engaging with the collar, the solenoid being electrically driven by a controller.

3. A device according to claim 1, wherein said second trigger mechanism includes:

a second collar mounted on said movable shaft;

an air cylinder;

a swinging plate supported on a movable frame connected to said air cylinder, said swinging plate being engagable with said second collar.

4. A device according to claim 1, wherein said urging means includes a compression coil spring and a retainer therefor.

5. A method for continuously winding a wire-like element comprising the steps of:

winding the wire-like element on a first bobbin while maintaining a piston of an air cylinder in a first position which allows free rotation of the bobbin;

moving the piston to a second position while maintaining a solenoid in an ON state so as to prepare to engage the first bobbin;

turning the solenoid to an OFF state so as to allow a cam plate to engage the first bobbin;

switching the winding of the wire-like element from the first bobbin to a second bobbin; and returning the piston to the first position to disengage the cam plate from the first bobbin.

* * * * *